US007196287B2

(12) United States Patent
Asai

(10) Patent No.: US 7,196,287 B2
(45) Date of Patent: Mar. 27, 2007

(54) UNIT ASSEMBLY STRUCTURE AND FUSER OF IMAGE FORMATION APPARATUS

(75) Inventor: Toshinori Asai, Daito (JP)

(73) Assignees: Funai Electric Co., Ltd., Osaka (JP); Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/358,640

(22) Filed: Feb. 21, 2006

(65) Prior Publication Data

US 2006/0213894 A1 Sep. 28, 2006

(30) Foreign Application Priority Data

Mar. 25, 2005 (JP) ..... 2005-088641

(51) Int. Cl.
*H05B 3/00* (2006.01)
*H05B 11/00* (2006.01)

(52) U.S. Cl. ..... 219/216; 399/122; 399/124; 399/113; 399/328; 399/320; 399/321

(58) Field of Classification Search ..... 219/216; 399/122, 124, 113, 328, 320, 321
See application file for complete search history.

(56) References Cited

U.S. PATENT DOCUMENTS 5,572,307 A * 11/1996 Tomatsu et al. ..... 399/122
5,758,252 A * 5/1998 Enomoto et al. ..... 399/407
6,104,889 A * 8/2000 Saitoh ..... 399/12
6,819,895 B2 * 11/2004 Suzuki ..... 399/122
6,990,303 B2 * 1/2006 Suzuki ..... 399/122
2003/0118382 A1 * 6/2003 Tomatsu ..... 399/328

FOREIGN PATENT DOCUMENTS

JP 06-348164 12/1994
JP 07-084419 3/1995

OTHER PUBLICATIONS

Patent Abstracts of Japan, Application No. 07-084419, dated Mar. 31, 1995 (2 pages).
Patent Abstracts of Japan, Application No. 06-348164, dated Dec. 22, 1994 (2 pages).

* cited by examiner

*Primary Examiner*—Robin Evans
*Assistant Examiner*—Vinod Patel
(74) *Attorney, Agent, or Firm*—Osha Liang LLP

(57) ABSTRACT

A fuser includes a fusing roll unit having a fusing roll, a pressurizing roll unit having a pressurizing roll and a coil spring resiliently biasing the pressurizing roll. The units are secured by a pair of engagements. One engagement includes a hook provided at the fusing roll unit and an eye provided at the pressurizing roll unit and capable of guiding and thus moving the units pivotably relative to each other when said hook is engaged therein. The fuser can thus have a simple structure formed of a reduced number of components and enhancing workability and facilitating its fabrication.

5 Claims, 5 Drawing Sheets

UNIT ASSEMBLY STRUCTURE AND FUSER OF IMAGE FORMATION APPARATUS

BACKGROUND OF THE INVENTION

1. Field of the Invention

The present invention relates generally to unit assembly structures allowing two units having internal repulsive force after assembly to be assembled against the internal repulsive force, and particularly to assembly structures for a fuser of an image formation apparatus that includes a fusing roll unit having a fusing roll and a pressurizing roll unit having a pressurizing roll and assembled with the fusing roll unit.

2. Description of the Background Art

Image formation apparatuses placing toner on a sheet and heating and pressurizing the sheet with the toner thereon to fuse the toner on the sheet are known in the form of printers, copiers, facsimiles and the like. Such an image formation apparatus has a fuser mounted therein in order to fuse the toner on the sheet. The fuser is typically configured of a fusing roll having a heating function and a pressurizing roll pressed into contact with the fusing roll such that a sheet having toner thereon passes a portion at which the rolls mutually contact.

The above described fuser incorporates a resilient biasing member therein to press the pressurizing roll into contact with the fusing roll. To cause the member to bias, in most cases a load of approximately 10 kgf is required, and this biasing force impairs workability in fabricating the fuser.

To address this, for example, Japanese Patent Laying-Open Nos. 7-84419 and 6-348164 disclose techniques.

Japanese Patent Laying-Open No. 7-84419 discloses a fuser. More specifically, the fuser includes a casing having a main body provided at a side portion with a slit receiving the axes of fusing and pressurizing rolls and the rolls are successively inserted into the slit with a resilient biasing member implemented by a coil spring posed between the fuser's bottom surface and the pressurizing roll's axis, and the casing's lid provided at an upper portion of the casing's main body to be opened and closed as desired is closed to press the fusing roller's axis downward toward the casing's bottom surface, while the lid is locked to the main body to press the pressurizing roll into contact with the fusing roll.

Japanese Patent Laying-Open No. 6-348164 discloses a fuser. More specifically, a casing of a fusing roll unit having a fusing roll incorporated therein and a casing of a pressurizing roll unit having a pressurizing roll incorporated therein are pivotably attached with a pin. The casings have side portions, respectively, notched to receive the rolls' axes. The pair of casings rotates around the pin, and a hook provided at each casing locks the pair of casings with the rolls sandwiched. Note that the hook provided at the pressurizing roll unit is rotatably attached to the casing of the pressurizing roll unit and is also biased by a resilient biasing member implemented by a coil spring. The coil spring's biasing force enables the pressurizing roll to be pressed into contact with the fusing roll with the hook engaging the pair of casings.

As disclosed in the above publications, however, the casings must be pivotably attached by using a pin or the like. This not only renders the casing complex in structure but also contributes to an increased number of components and a cumbersome assembly process. Such can hardly be an assembly structure suitable for mass production.

In assembly a dedicated jig can be used to compress the resilient biasing member or coil spring to prevent the coil spring's biasing force from being an obstacle to the assembly. This, however, requires attaching and removing the jig and hence cannot avoid a cumbersome assembly, and also requires an additional cost for producing the jig.

For unit assembly structures that require two units having internal repulsive force after assembly to be assembled against the internal repulsive force, as described above for a fuser of an image formation apparatus, the internal repulsive force impairs workability in the assembly.

SUMMARY OF THE INVENTION

The present invention contemplates a unit assembly structure allowing two units having internal repulsive force after assembly to be assembled against the internal repulsive force, that allows enhanced workability in and can also facilitate the assembly.

The present invention also contemplates a fuser of an image formation apparatus that has a simple structure providing a reduced number of components, and also allowing enhanced workability in and also facilitating its fabrication.

The present invention in a first aspect provides a fuser of an image formation apparatus that includes a fusing roll unit having a fusing roll and a pressurizing roll unit having a pressurizing roll and a resilient biasing member resiliently biasing the pressurizing roll, the resilient biasing member pressing the pressurizing roll into contact with the fusing roll as the pressurizing roll unit is secured to the fusing roll unit. The fusing and pressurizing roll units are secured by a pair of engagements provided at locations, respectively, sandwiching a plane including an axial line of the fusing roll and that of the pressurizing roll. Of the pair of engagements, one engagement includes a hook provided at one of the units and an eye provided at the other of the units and capable of guiding and thus moving one unit pivotably relative to the other unit when the hook is engaged therein. Of the pair of engagements, the other engagement includes a protrusion provided at one of the units and a hole provided at the other of the units to receive the protrusion to secure the units together. The hole is provided at a projection projecting from the unit with the hole toward the unit with the protrusion. The projection has an end with a corner closer to one engagement tapered. The protrusion has an end with a corner closer to the unit with the hole tapered.

Thus the fusing roll unit and the pressurizing roll unit can be assembled together simply by engaging the hook with the eye and rotating and thus moving one unit relative to the other unit around the hook-eye engagement to allow the units to be assembled against the resilient biasing member's biasing force. Thus the assembly can be facilitated and the assembly process can be simplified. Furthermore a pin or the like for pivotal attachment can be dispensed with. This can provide a reduced number of components and reduced production cost. Furthermore, as one unit is pivoted relative to the other unit around the hook-eye engagement, the protrusion accordingly, smoothly fits into the securing hole. The fusing and pressurizing roll units can thus be assembled together by a significantly simple operation. Furthermore the protrusion can smoothly be guided into the securing hole, and the units can be assembled together with further reduced force.

The present invention in a second aspect provides a fuser of an image formation apparatus that includes a fusing roll unit having a fusing roll and a pressurizing roll unit having a pressurizing roll and a resilient biasing member resiliently biasing the pressurizing roll, the resilient biasing member pressing the pressurizing roll into contact with the fusing roll as the pressurizing roll unit is secured to the fusing roll unit. The fusing and pressurizing roll units are secured by a pair of engagements provided in a direction traversing the fusing roller's axial direction. Of the pair of engagements, one engagement includes a hook provided at one of the units and an eye provided at the other of the units and capable of guiding and thus moving one unit pivotably relative to the other unit when the hook is engaged therein.

Thus the fusing roll unit and the pressurizing roll unit can be assembled together simply by engaging the hook with the eye and rotating and thus moving one unit relative to the other unit around the hook-eye engagement to allow the units to be assembled against the resilient biasing member's biasing force. Thus the assembly can be facilitated and the assembly process can be simplified. Furthermore a pin or the like for pivotal attachment can be dispensed with. This can provide a reduced number of components and reduced production cost.

Preferably, of the pair of engagements, the other engagement includes a protrusion provided at one of the units and a hole provided at the other of the units to receive the protrusion to secure the units together.

As one unit is pivoted relative to the other unit around the hook-eye engagement, the protrusion accordingly, smoothly fits into the securing hole. The fusing and pressurizing roll units can thus be assembled together by a significantly simple operation.

Preferably the hole is provided at a projection projecting from the unit with the hole toward the unit with the protrusion, and in that case the projection has an end with a corner closer to one engagement tapered and the protrusion has an end with a corner closer to the unit with the hole tapered.

Thus the protrusion can smoothly be guided into the securing hole, and the fusing and pressurizing roll units can be assembled together with further reduced force.

Preferably the pair of engagements is provided at locations, respectively, sandwiching a plane including an axial line of the fusing roll and that of the pressurizing roll.

The fusing and pressurizing roll units can be secured at locations sandwiching a portion at which the fusing and pressurizing rolls mutually contact. The pressurizing roll can be pressed into contact with the fusing roll steadily.

Preferably, more than one the pair of engagements is provided in a direction parallel to the fusing roll's axial direction.

Thus the fusing and pressurizing roll units can be assembled together with high precision.

The present invention provides a unit assembly structure including a first unit, a second unit assembled to the first unit, and a resilient biasing member biased to allow the first and second units to be move away from each other. The first and second units are secured by a pair of engagements against a resilient, biasing force exerted by the resilient biasing member. Of the pair of engagements, one engagement includes a hook provided at one unit and an eye provided at the other unit and capable of guiding and thus moving one unit pivotably relative to the other unit when the hook is engaged therein.

Thus one unit and the other unit can be assembled together simply by engaging the hook with the eye and rotating and thus moving one unit relative to the other unit around the hook-eye engagement to allow the units to be assembled against the resilient biasing member's biasing force. Thus the assembly can be facilitated and the assembly process can be simplified. Furthermore a pin or the like for pivotal attachment can be dispensed with. This can provide a reduced number of components and reduced production cost.

Preferably, of the pair of engagements, the other engagement includes a protrusion provided at one of the units and a hole provided at the other of the units to receive the protrusion to secure the units together.

As one unit is pivoted relative to the other unit around the hook-eye engagement, the protrusion accordingly, smoothly fits into the securing hole. The units can thus be assembled together by a significantly simple operation.

Preferably the hole is provided at a projection projecting from the unit with the hole toward the unit with the protrusion and in that case the projection has an end with a corner closer to one engagement tapered and the protrusion has an end with a corner closer to the unit with the hole tapered.

Thus the protrusion can smoothly be guided into the securing hole, and the first and second units can be assembled together with further reduced force.

Preferably, more than one the pair of engagements is provided.

Thus the first and second units can be assembled together with high precision.

Thus the present invention can provide a fuser of an image formation apparatus that has a simple structure allowing a reduced number of components and also enhancing workability in and facilitating its fabrication.

Furthermore the present invention can implement a unit assembly structure requiring two units having internal repulsive force after assembly to be assembled against the internal repulsive force, that allows enhanced workability in and can also facilitate the assembly.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter the present invention in one embodiment will be described with reference to the drawings more specifically. Hereinafter a device requiring two units having internal repulsive force after assembly to be assembled together against the internal repulsive force will be described in the form by way of example of a fuser mounted in a printer.

Figure 1:
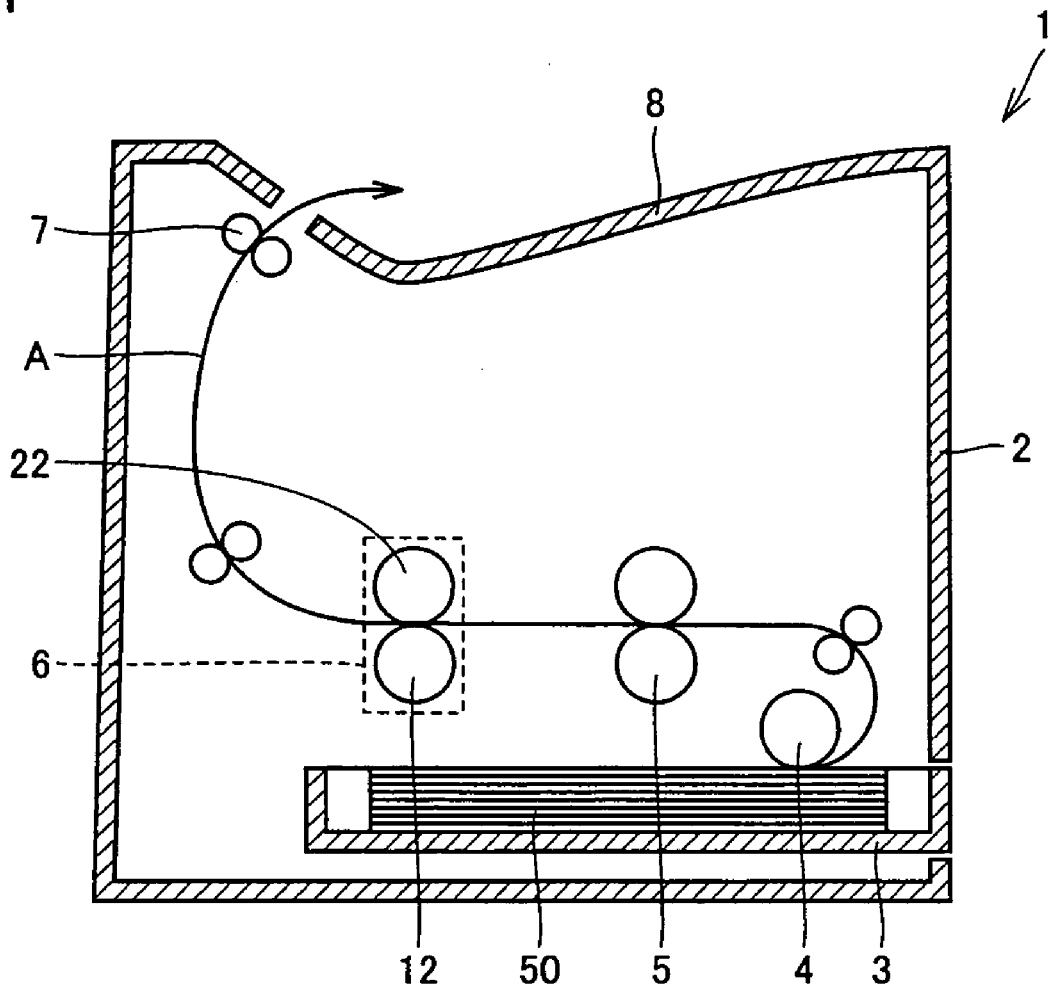
FIG. 1 is a schematic cross section of a printer having mounted therein a fuser of the present invention in an embodiment.

Initially will be described a structure of the printer having mounted therein a fuser of the present invention in one embodiment. FIG. 1 is a schematic cross section of the printer.

As shown in the figure, a printer 1 includes a casing 2, and a sheet feed tray 3 disposed in casing 2 at a lower portion to be drawably. Sheet feed tray 3 is supplied with a sheet 50, which is output via a variety of rolls, a guiding plate (not shown) and the like, which are arranged on a path A through casing 2 to feed the sheet, to a sheet discharging tray 8 provided at an upper portion of casing 2. Mainly arranged on path A are a sheet feed roll 4 extracting sheets 50 from sheet feed tray 3 one by one, a photoreceptor 5 allowing toner to adhere on a surface of sheet 50, a fuser 6 having a fusing roll 12 and a pressurizing roll 22 for fusing the toner placed on the plane of sheet 50, a sheet discharging roll 7 discharging sheet 50 on sheet discharging tray 8, and the like.

Figure 2:
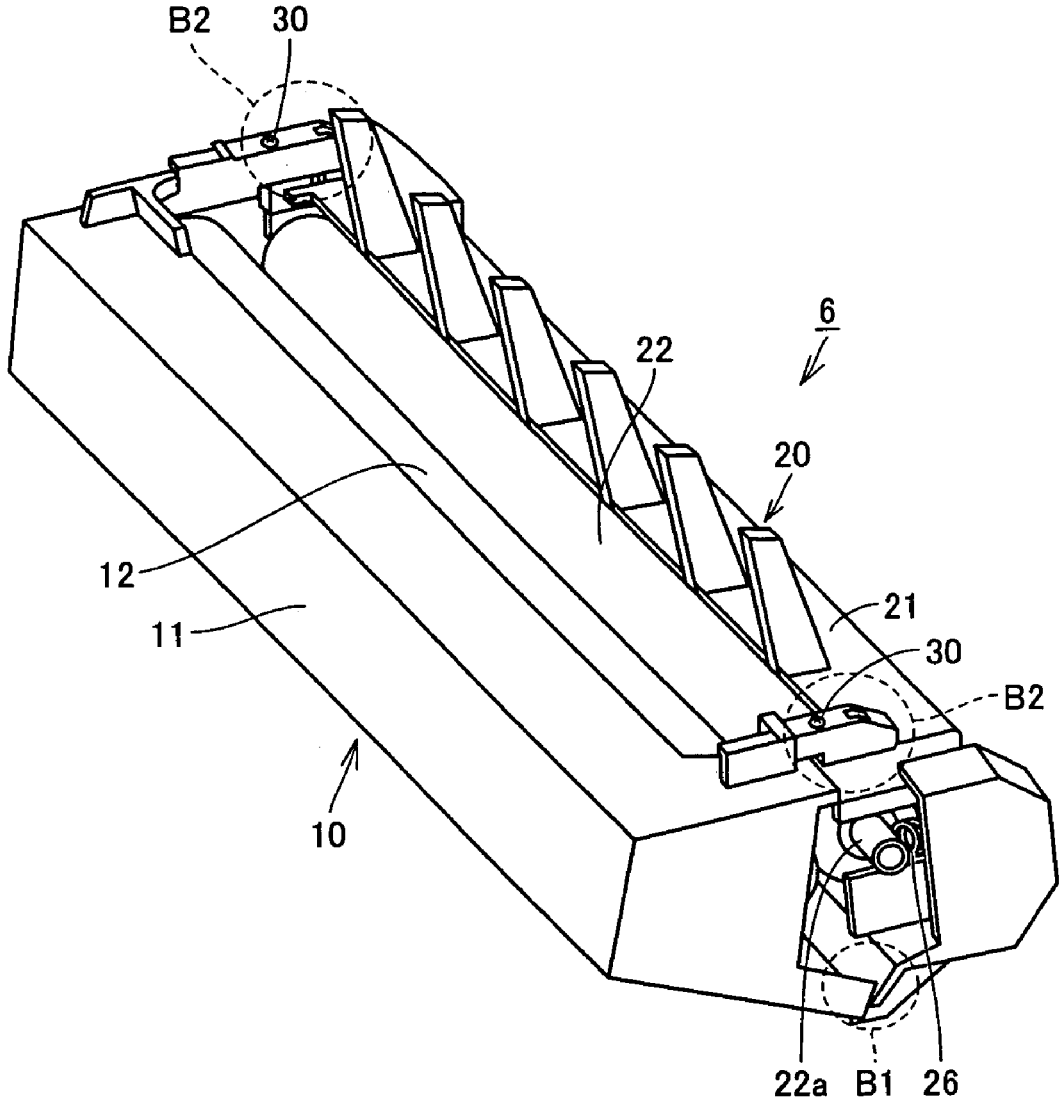
FIG. 2 generally shows the present fuser in a perspective view.
Figure 3:
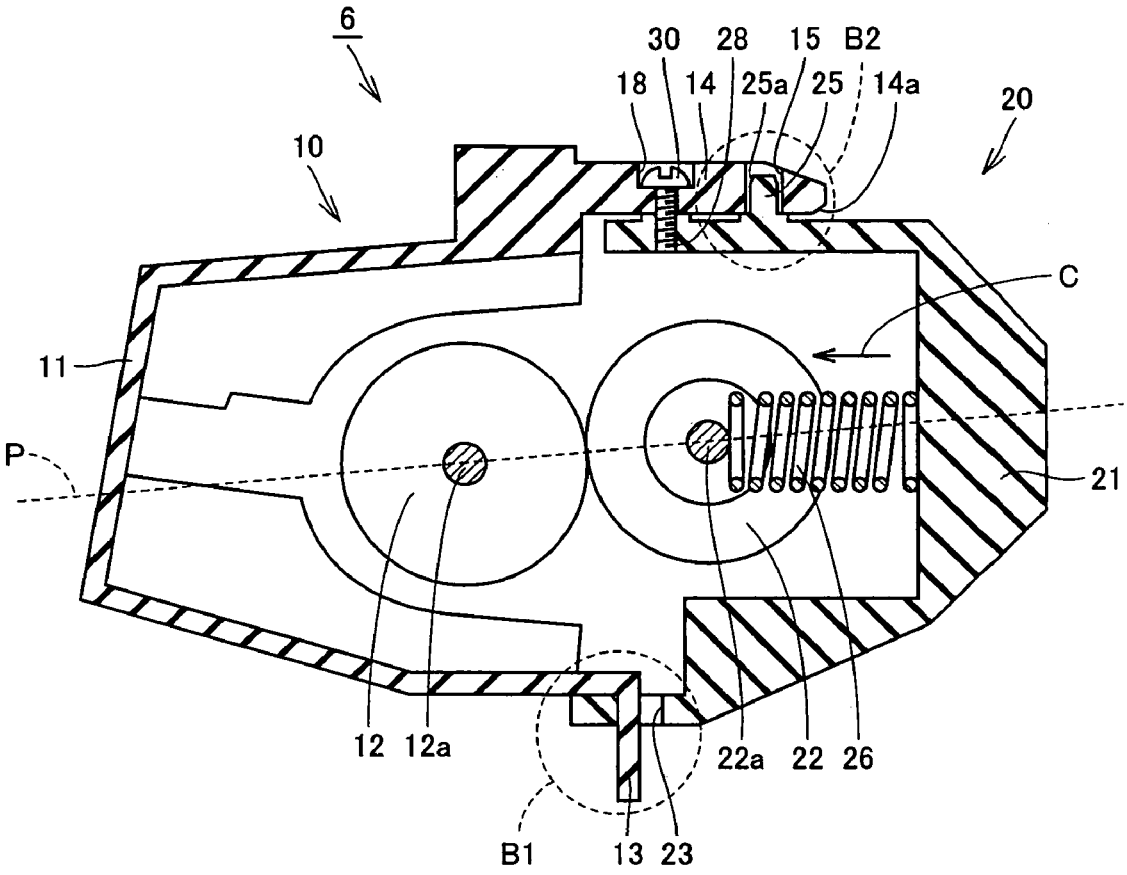
FIG. 3 is a schematic cross section of the present fuser.

In the present embodiment the fuser has a structure as described hereinafter. FIG. 2 generally shows the fuser in a perspective view. FIG. 3 is a schematic cross section of the fuser. As shown in the figures, the present embodiment provides a fuser 6 including a fusing roll unit 10 incorporating fusing roll 12 and a pressurizing roll unit 20 incorporating pressuring roll 22.

Fusing roll unit 10 mainly includes a casing 11 in the form of a box having an opening in a plane thereof located closer to pressurizing roll unit 20, and fusing roll 12 rotatably supported by a shaft at longitudinally opposite ends of casing 11. Fusing roll 12 is also referred to as a heat roll or a hot roll. It has a source of heat at the center and has a circumferential surface provided with a thin coating formed for example of polytetrafluoroethylene resin or a similar mold releasing material.

Pressurizing roll unit 20 mainly includes a casing 21 in the form of a box having an opening in a plane thereof located closer to fusing roll unit 10, pressurizing roll 22 rotatably supported by a shaft at longitudinally opposite ends of casing 21, and a coil spring 26 serving as a member resiliently biasing pressurizing roll 22. Pressurizing roll 22 is also referred to as a reduction roll or a pressing roll and has a circumferential surface provided with a thick, elastic layer formed for example of silicon rubber or a similar mold releasing material.

Casings 11 and 21 are secured by a pair of engagements B1 and B2 provided at casings 11 and 21. The pair of engagements B1 and B2 is provided in a direction traversing that in which an axis 12*a* of the fusing roll extends. More specifically, the pair of engagements is provided at positions sandwiching a plane including axial lines of fusing and pressurizing rolls 12 and 22, respectively, as indicated in FIG. 3 by a broken line P. In the present embodiment fuser 6 has engagement B1 at a lower portion thereof and engagement B2 at an upper portion thereof. Furthermore, as shown in FIG. 2, two such pairs of engagements B1 and B2 are provided to the casings at opposite ends as seen along fusing roll 12, (or fuser 6).

As shown in FIG. 3, of the pair of engagements B1 and B2, one engagement B1 includes a hook 13 provided to casing 11 and an eye 23 provided to casing 21. Hook 13 is formed to be capable of engaging with eye 23 in assembling units 10 and 20 and when eye 23 receives hook 13 casing 11 is rotatably movable relative to casing 21. Once units 10 and 20 have been assembled, hook 13 is secured in eye 23.

Of the pair of engagements B1 and B2 the other engagement B2 includes a protrusion 25 provided to casing 21 and a hole 15 formed in a wall of casing 11 at a projection 14 projecting toward casing 21 and when units 10 and 20 are assembled together hole 15 receives protrusion 25 to secure casings 11 and 21 together. Projection 14 has an end having a corner closer to engagement B1 (or facing downward in the figure) tapered 14*a*. Furthermore, protrusion 25 has an end having a corner closer to unit 10 (or a left corner as seen in FIG. 3) tapered 25*a*.

Projection 14 is provided with a screw hole 18, and casing 21 at a prescribed position is provided with a screw hole 28. Screw holes 18 and 28 with unit 10 and 20 assembled together face each other, and a screw 30 is tightened into screw holes 18 and 28 to secure casings 11 and 12 together.

As shown in FIG. 3, when casing 21 is secured to casing 11, pressurizing roll 22 will have its axis 22*a* biased by coil spring 26 in a direction indicated in the figure by an arrow C. Pressurizing roll 22 is thus pressed into contact with fusing roll 12. More specifically, coil spring 26 is compressed as it is arranged and sandwiched between axis 22*a* of pressurizing roll 22 and an internal wall surface of casing 21, and thereby pressurizing roll 22 is pressed into contact with fusing roll 12. In this condition, a sheet with toner placed thereon is fed to a portion at which fusing and pressurizing rolls 12 and 22 mutually contact. The source of heat provided at fusing roll 12 heats and thus fuses the toner, and pressurizing roll 22 presses the fused toner on a plane of the sheet and consequently fixes the toner on the plane of the sheet.

Figure 4:
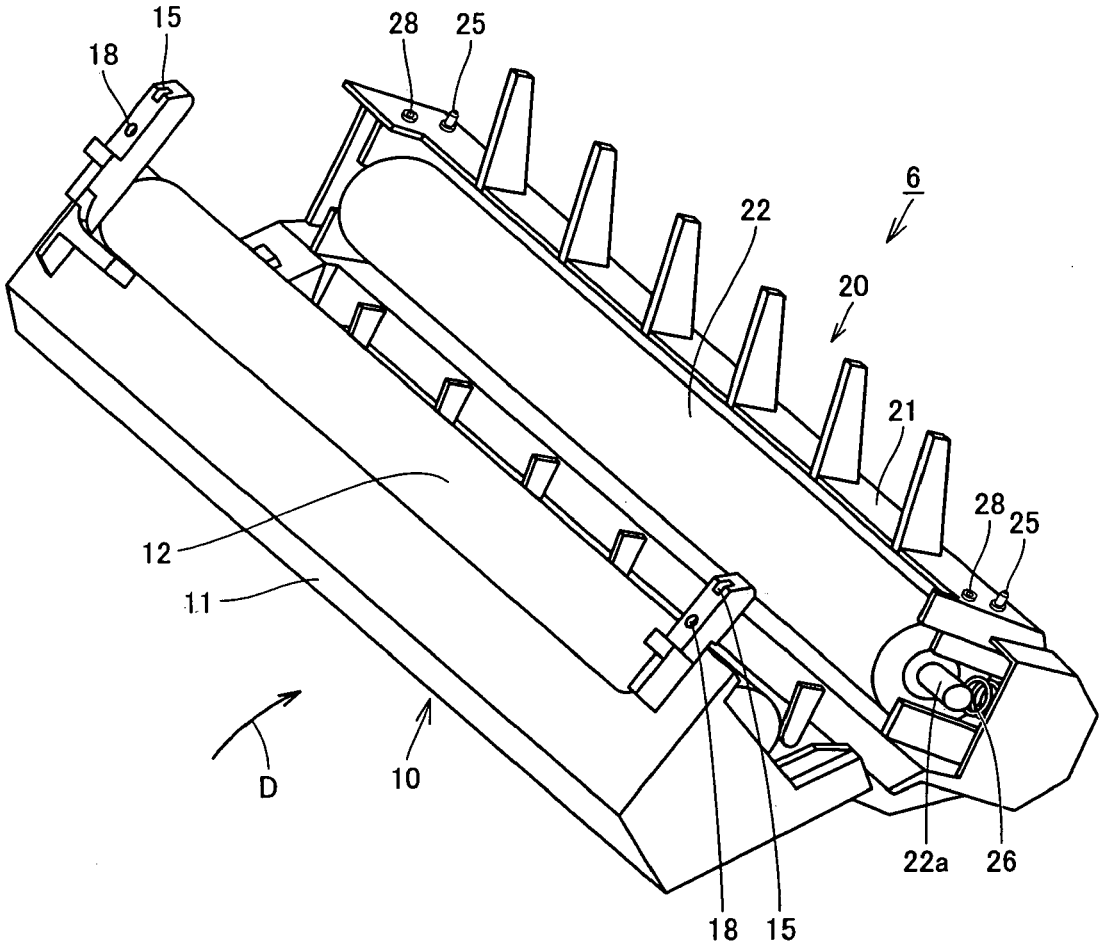
FIG. 4 generally shows the present fuser in a perspective view for illustrating a procedure of assembling the fuser.

Hereinafter will be described a procedure of an assembly to implement the structure of the assembly of the fuser as described above. FIG. 4 is a general, perspective view for illustrating the procedure, and FIGS. 5 and 6 are schematic cross sections therefor.

Figure 5:
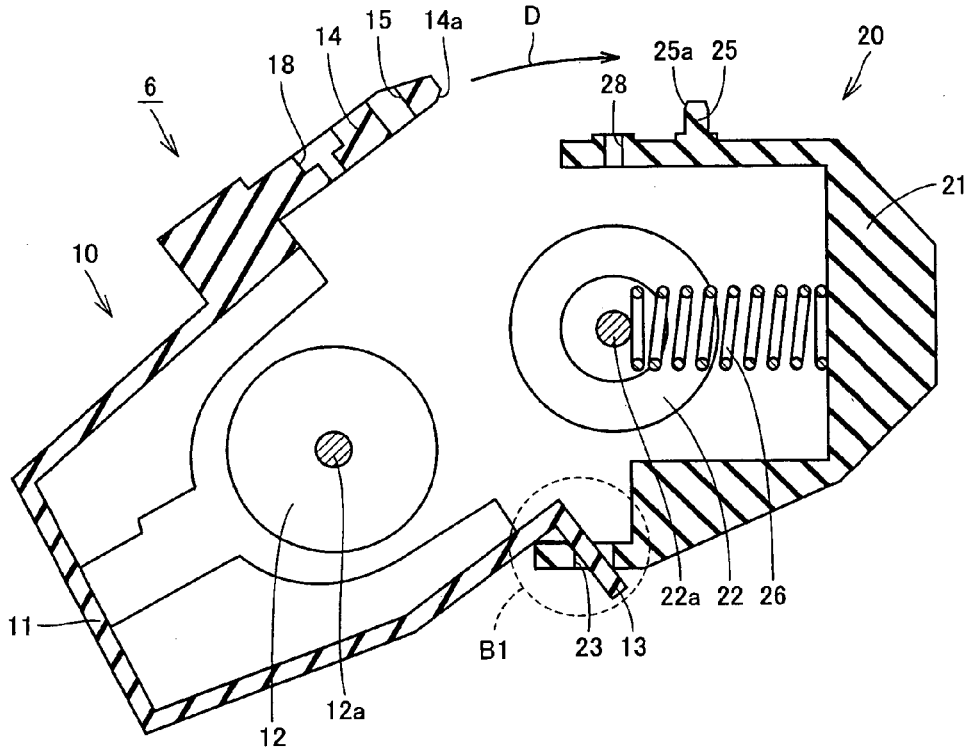
FIGS. 5 and 6 are schematic cross sections for illustrating the procedure of assembling the fuser.

Units 10 and 20 are assembled together to fabricate fuser 6, as follows: initially, as shown in FIGS. 4 and 5, unit 10 and 20 have their respective openings facing each other, with casing 11 having hook 13 engaged with casing 21 through eye 23.

Then, as shown in FIGS. 4 and 5, while hook 13 is engaged with eye 23, casing 11 is rotated in a direction D around engagement B1. When casing 11 is rotated by a prescribed amount, fusing and pressurizing rolls 12 and 22 contact each other as shown in FIG. 6.

Figure 6:
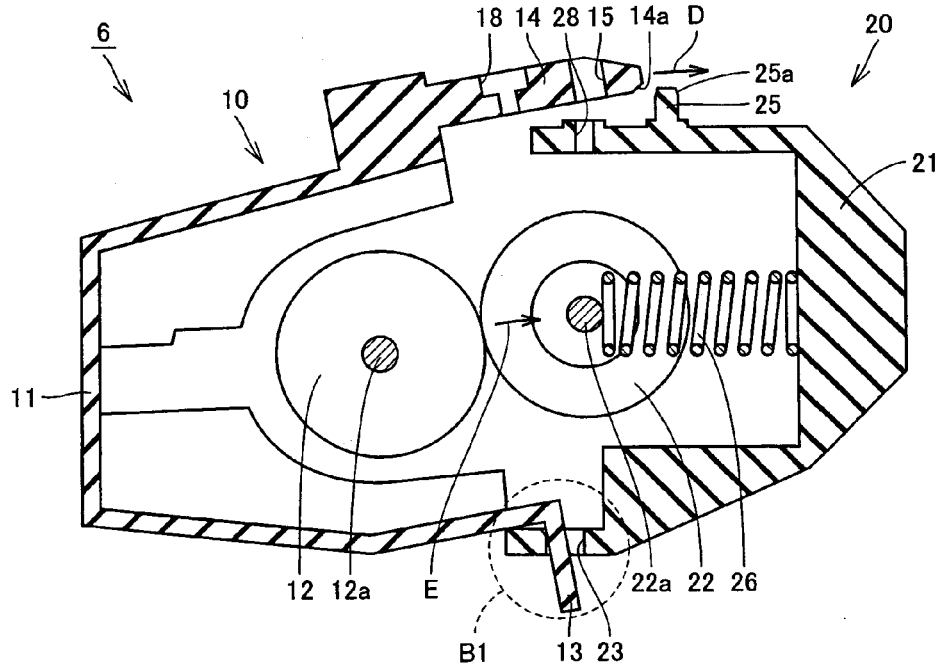

At the FIG. 6 position when casing 11 is further rotated in direction D, pressurizing roll 22 is pushed by fusing roll 12 in a direction E and coil spring 26 will accordingly be compressed. When casing 11 is further rotated in direction D and pressurizing roll 22 is pressed by a prescribed amount, tapered surface 25*a* provided at the end of protrusion 25 provided at an upper portion of casing 21, contacts tapered surface 14*a* provided at the end of projection 14 provided at an upper portion of casing 11. As projection 14 flexes upward, protrusion 25 is smoothly guided into hole 15. Thus at engagements B1 and B2 casings 11 and 21 are secured together and units 10 and 20 are provisionally secured together.

After the units have provisionally been secured together, screw 30 is tightened into screw holes 18 and 28 of casings 11 and 21, respectively, to finally secure unit 10 and 20 together. Thus fuser 6 having the structure shown in FIGS. 2 and 3 is obtained.

Thus the present embodiment can provide a fuser having a structure simply engaging a hook with an eye and rotating one casing relative to the other casing to assemble a pressurizing roll unit with a fusing roll unit. Furthermore, as one unit is pivoted relative to the other unit around an engagement defined by the hook and the eye, a protrusion accordingly, smoothly fits into a securing hole. The fusing and pressurizing roll units can thus be assembled together by a significantly simple operation. This can eliminate an excessive component such as a pin for pivotal attachment required as conventional and contribute to a reduced number of components and a simplified fabrication process, and the fuser can inexpensively be produced.

Furthermore, the projection and the protrusion can have their respective corners tapered so that when the corners mutually contact, the protrusion can smoothly be guided and thus inserted into the securing hole. Only a small amount of force is required to assemble the fusing and pressurizing roll units together. Furthermore to maximize the distance between the paired engagements the present fuser has the paired engagements arranged therein at upper and lower portions, respectively. Ensuring a large distance between the paired engagements allows the fusing and pressurizing roll units to be assembled together with further reduced force. As such, if the resilient biasing member of coil spring has a biasing force of approximately 10 kgf or larger, the fusing and pressurizing roll units can still be manually assembled together readily in a short period of time. Significantly improved workability can thus be achieved.

Furthermore, as the pair of engagements is provided in a direction across the fusing roll's axial direction to sandwich the fusing roll's axial line, the pressurizing roll can be pressed into contact with the fusing roll steadily. Furthermore, two such pairs of engagements can be provided along the fuser to provide positioning between the units. The units can be assembled together with high precision.

While in the above described one embodiment of the present invention a fuser mounted in a printer is exemplified for illustration, the present invention is applicable not only to this type of fuser but also any products that require two units having internal repulsive force after assembly to be assembled together against the internal repulsive force.

Furthermore, while the present invention in the above one embodiment has been described with a hook-eye engagement paired with another engagement defined by a protrusion and a securing hole, the latter engagement may have a different structure. Furthermore, the pair of engagements may be provided at a position other than described above.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fuser of an image formation apparatus, comprising a fusing roll unit having a fusing roll and a pressurizing roll unit having a pressurizing roll and a resilient biasing member resiliently biasing said pressurizing roll, said resilient biasing member pressing said pressurizing roll into contact with said fusing roll as said pressurizing roll unit is secured to said fusing roll unit, wherein:

said fusing and pressurizing roll units are secured by a pair of engagements provided at locations, respectively, sandwiching a plane including an axial line of said fusing roll and that of said pressurizing roll;

of said pair of engagements, one engagement includes a hook provided at one of said units and an eye provided at the other of said units and capable of guiding and thus moving said one unit pivotably relative to said other unit when said hook is engaged therein;

of said pair of engagements, the other engagement includes a protrusion provided at one of said units and a hole provided at said other of said units to receive said protrusion to secure said units together;

said hole is provided at a projection projecting from said unit with said hole toward said unit with said protrusion;

said projection has an end with a corner closer to said one engagement tapered; and said protrusion has an end with a corner closer to said unit with said hole tapered.

2. A fuser of an image formation apparatus, comprising:

a fusing roll unit having a fusing roll, and a pressurizing roll unit having a pressurizing roll and a resilient biasing member resiliently biasing said pressurizing roll, said resilient biasing member pressing said pressurizing roll into contact with said fusing roll as said pressurizing roll unit is secured to said fusing roll unit, wherein said fusing and pressurizing roll units are secured by a pair of engagements provided in a direction traversing said fusing rollert's axial direction;

wherein of said pair of engagements, one engagement includes a hook provided at one of said units and an eye provided at the other of said units capable of guiding and thus moving said one unit pivotably relative to said another unit when said hook is engaged therein; and wherein of said pair of engagements, the other engagement includes a protrusion provided at one of said units and a hole provided at the other of said units to receive said protrusion to secure said units together.

3. The fuser of claim 2, wherein:

said hole is provided at a projection projecting from said unit with said hole toward said unit with said protrusion;

said projection has an end with a comer closer to said one engagement tapered; and said protrusion has an end with a corner closer to said unit with said hole tapered.

4. The fuser of claim 2, wherein said pair of engagements is provided at locations, respectively, sandwiching a plane including an axial line of said fusing roll and that of said pressurizing roll.

5. The fuser of claim 2, wherein more than one said pair of engagements is provided in a direction parallel to said fusing roll's axial direction.

* * * * *